US009770112B2

(12) United States Patent
Wu

(10) Patent No.: US 9,770,112 B2
(45) Date of Patent: Sep. 26, 2017

(54) CHAIR AND FURNITURE SET WITH THE CHAIR

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 257 days.

(21) Appl. No.: 14/752,118

(22) Filed: Jun. 26, 2015

(65) Prior Publication Data

US 2016/0374470 A1 Dec. 29, 2016

(51) Int. Cl.

| | |
|---|---|
| ***A47B 83/00*** | (2006.01) |
| ***A47C 13/00*** | (2006.01) |
| ***A47C 4/02*** | (2006.01) |
| *A47B 83/02* | (2006.01) |

(52) U.S. Cl.

CPC ..... *A47C 13/005* (2013.01); *A47B 83/001* (2013.01); *A47C 4/02* (2013.01); *A47B 83/02* (2013.01)

(58) Field of Classification Search

CPC ..... A47C 4/02; A47C 13/005; A47C 1/124; A47B 83/00; A47B 83/001; F16B 45/00

See application file for complete search history.

(56) References Cited

U.S. PATENT DOCUMENTS 3,584,916 A * 6/1971 Bayes ..... A47C 1/124 297/232
4,580,841 A * 4/1986 Raftery ..... A47C 4/02 297/451.8
5,498,052 A * 3/1996 Severini ..... B60N 2/305 296/65.09
6,447,067 B1 * 9/2002 Williams ..... A47C 4/021 297/184.11
6,460,922 B1 * 10/2002 Demick ..... B60N 2/3034 296/65.11
6,629,729 B2 * 10/2003 Wiedeman ..... B60N 2/3011 296/65.09
7,270,371 B2 * 9/2007 Adragna ..... B60N 2/2209 296/65.09
7,517,008 B2 * 4/2009 Ebel ..... B60N 2/3031 296/65.05
8,403,421 B2 * 3/2013 Wang ..... A47C 5/06 297/440.11
8,770,659 B2 * 7/2014 Isherwood ..... B64D 11/0691 297/14

(Continued)

*Primary Examiner* — Timothy J Brindley

(74) *Attorney, Agent, or Firm* — Birch, Stewart, Kolasch & Birch, LLP

(57) ABSTRACT

A chair has a seat member and a backrest member. The seat member has a seat body having a horizontal frame disposed horizontally; a front supporting leg mounted on a bottom surface of the horizontal frame near a front end of the horizontal frame; and two rear supporting legs mounted respectively on two sides of a bottom surface of the horizontal frame near a rear end of the horizontal frame. The backrest member has a backrest frame having two backrest sidebars mounted respectively on two sides of the horizontal frame and an upper crossbar connected between two top ends of the backrest sidebars and having a suspension slot defined in a rear surface of the upper crossbar. The suspension slot is axially elongated and has an L-shaped cross section. The chair may be used independently and may be easily combined other furniture units to form a furniture set.

14 Claims, 24 Drawing Sheets

(56) References Cited

U.S. PATENT DOCUMENTS

| | | | | |
|---|---|---|---|---|
| 9,033,421 | B2 * | 5/2015 | Wilkinson | A47C 1/03 297/440.11 |
| 2005/0217022 | A1 * | 10/2005 | Oldham | A47C 13/005 5/52 |
| 2008/0164742 | A1 * | 7/2008 | Crowe | A47C 4/02 297/440.14 |
| 2014/0312661 | A1 * | 10/2014 | Behar | A47C 7/40 297/135 |
| 2016/0245005 | A1 * | 8/2016 | Tsuchiyama | E04B 2/7409 |
| 2017/0000259 | A1 * | 1/2017 | Tsuchiyama | A47C 1/124 |

* cited by examiner

CHAIR AND FURNITURE SET WITH THE CHAIR

BACKGROUND OF THE INVENTION

1. Field of the Invention

The present invention relates to a chair, and more particularly to a chair that is able to be used independently or combined detachably with other furniture units such as screens or tables to form a furniture set and improve use convenience and application versatility.

2. Description of Related Art

In the fields of offices, households and public places, chairs are classified into two categories: independent and movable chairs and combination chairs that are combined with other furniture units.

A conventional combination chair is firmly connected to other furniture unit such as a screen or a suspension table by inconvenient connection way such as soldering. For example, a row of chairs in public places such as hospitals is combined with multiple chair units.

In general, the aforementioned combination chair has a shortage of exclusive design for a specific field. The function of the combination chair is realized through the assistance of other combined units such that the combination chair cannot be utilized independently, is inconvenient to detach and cannot be flexibly combined to variety of other furniture units.

To overcome the shortcomings, the present invention provides a chair and furniture set with the chair to mitigate or obviate the aforementioned problems.

SUMMARY OF THE INVENTION

The main objective of the invention is to provide a chair that is able to be used independently or combined detachably with other furniture units such as screens or tables to form a furniture set and improve use convenience and application versatility.

A chair in accordance with the present invention comprises a seat member and a backrest member. The seat member has a seat body having a horizontal frame disposed horizontally; a front supporting leg mounted on a bottom surface of the horizontal frame near a front end of the horizontal frame; and two rear supporting legs mounted respectively on two sides of a bottom surface of the horizontal frame near a rear end of the horizontal frame. The backrest member has a backrest frame having two backrest sidebars mounted respectively on two sides of the horizontal frame and an upper crossbar connected between two top ends of the backrest sidebars and having a suspension slot defined in a rear surface of the upper crossbar. The suspension slot is axially elongated and has an L-shaped cross section. The chair may be used independently and may be easily combined other furniture units to form a furniture set.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
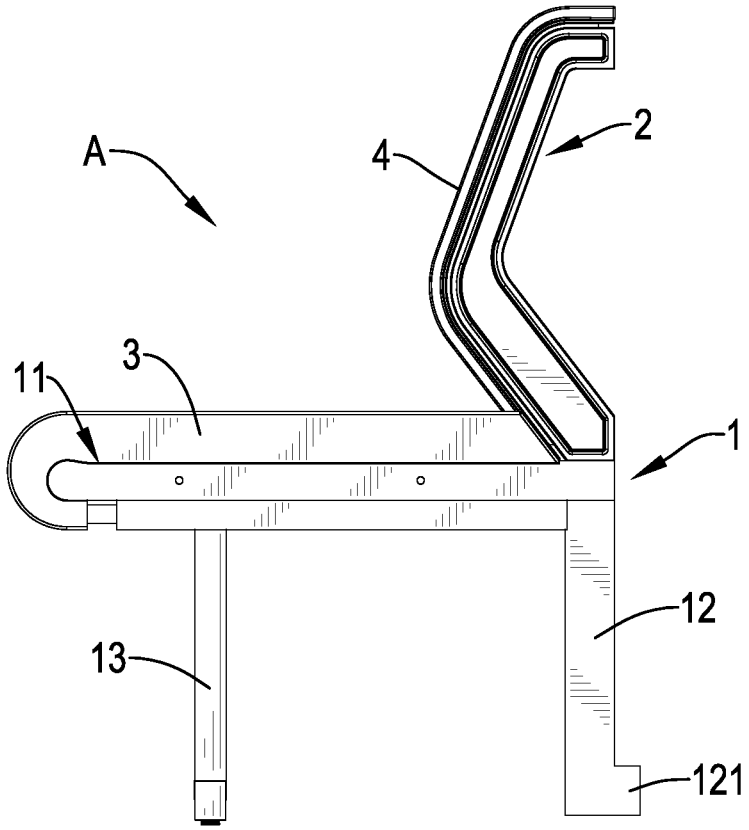
FIG. 1 is a side view of a first embodiment of a chair in accordance with the present invention.
Figure 2:
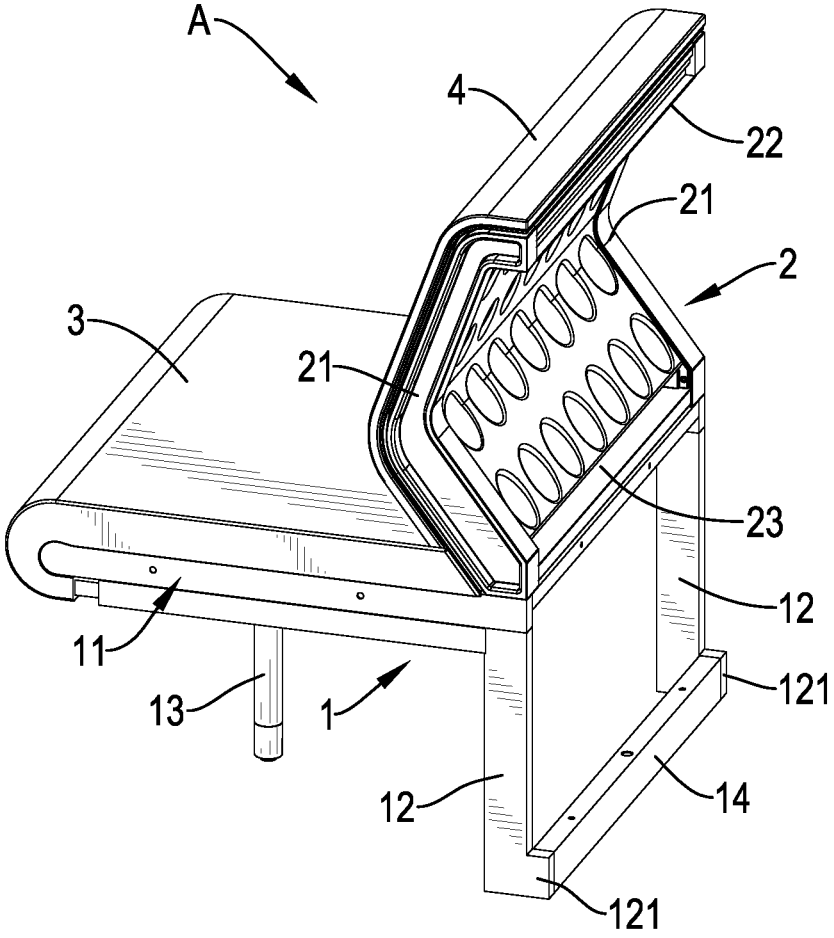
FIG. 2 is a perspective view of the chair in FIG. 1.

With reference to FIGS. 1 and 2, a first embodiment of a chair A in accordance with the present invention comprises a seat member and a backrest member.

Figure 3:
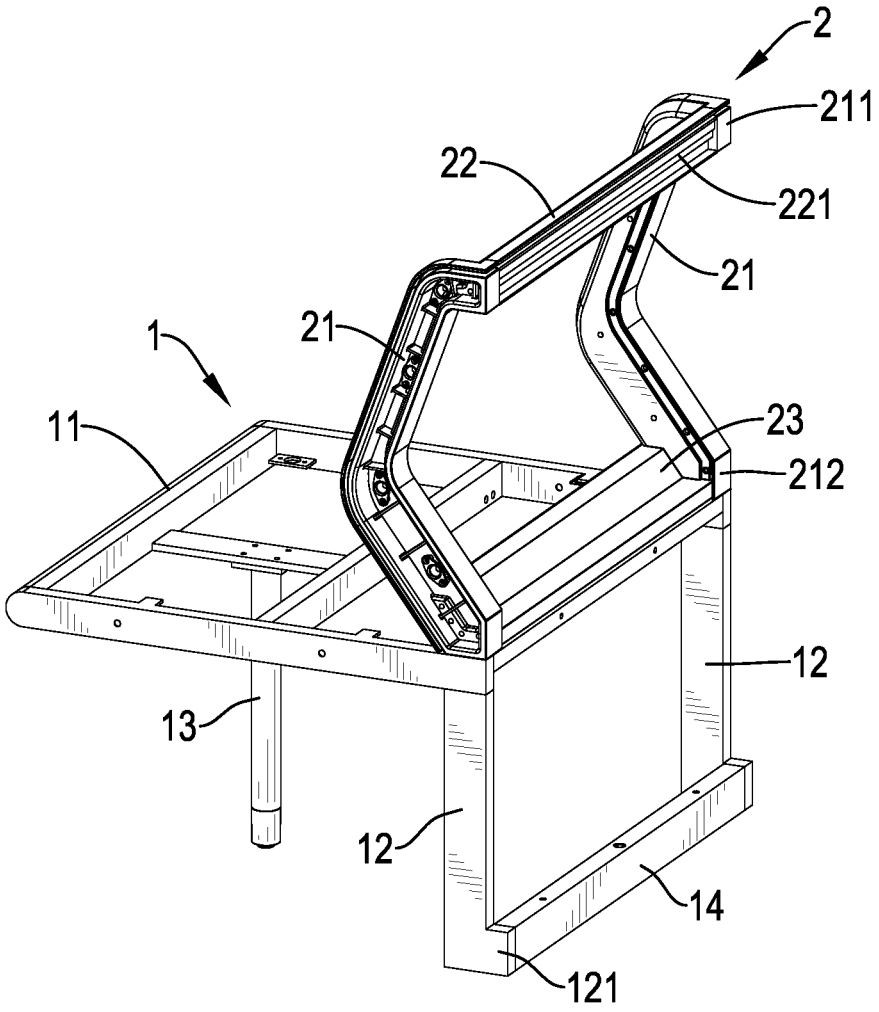
FIG. 3 is a perspective view of the chair in FIG. 1 omitting the seat pad the backrest pad.

With further reference to FIG. 3, the seat member has a seat body 1 and a seat pad 3.

The seat body 1 has a horizontal frame 11, a front supporting leg 13, two rear supporting legs 12 and a reinforcing crossbar 14.

The horizontal frame 11 is rectangular and is disposed horizontally.

The front supporting leg 13 is mounted on a bottom surface of the horizontal frame 11 near a front end of the horizontal frame 11.

The rear supporting legs 12 are mounted respectively on two sides of a bottom surface of the horizontal frame 11 near a rear end of the horizontal frame 11. Two rear surfaces of the rear supporting legs 12 are flush with each other. The front supporting leg 11 and the rear supporting legs cooperate to form a triangular supporting structure to stably support the horizontal frame 11. Each rear supporting leg 12 has a protrusion 121 formed on and protruding outward from the rear supporting leg 12 and having a horizontal top surface.

The reinforcing crossbar 14 is connected between the rear supporting legs 12 and has a top surface flush with the horizontal top surfaces of the protrusions 121 of the rear supporting legs 12 for connection with other furniture unit. The horizontal top surfaces of the rear supporting legs 12 and the top surface of the reinforcing crossbar 14 are functioned for support, position and connection with other furniture unit.

The seat pad 3 is mounted on the seat body 1.

The backrest member has a backrest frame 2 and a backrest pad 4.

The backrest frame 2 has two backrest sidebars 21, an upper crossbar 22 and a lower crossbar 23.

The backrest sidebars 21 may be V-shaped, are symmetrically mounted respectively on two sides of the horizontal frame 11. Each backrest sidebar 21 has an upper horizontal extension end portion 211 and a lower horizontal extension end portion 212. The upper horizontal extension end portion 211 is formed on a top end of the backrest sidebar 21. The lower horizontal extension end portion 212 is formed on a bottom end of the backrest sidebar 21.

Figure 4:
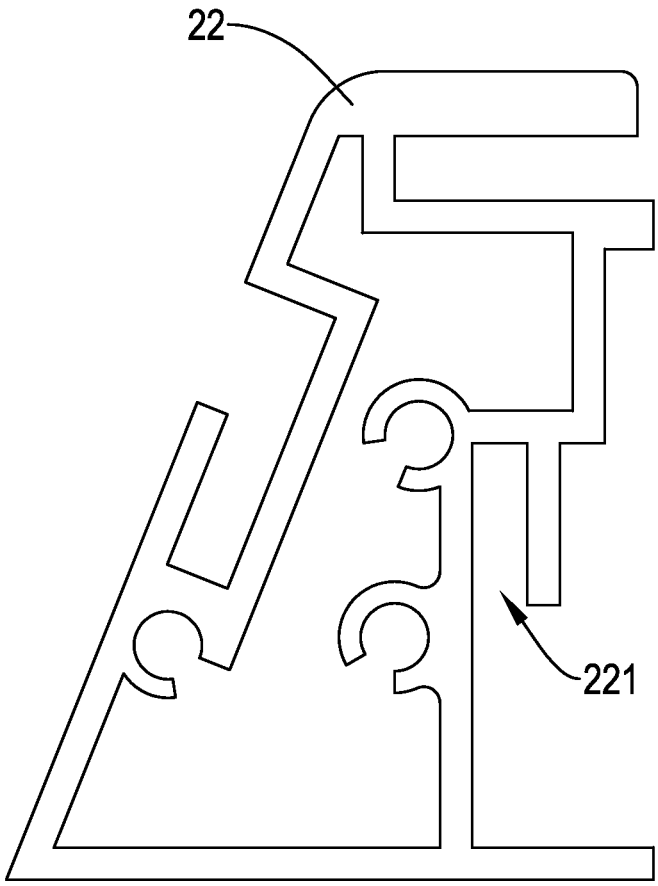
FIG. 4 is an end view of an upper crossbar of the chair in FIG. 1.

With further reference to FIG. 4, the upper crossbar 22 is straight, may be made by an extrusion process and cut according to a predetermined length, is connected between the upper horizontal extension end portions 211 of the backrest sidebars 21 and has a suspension slot 221 defined in a rear surface of the upper crossbar 22. The suspension slot 221 is axially elongated and has an L-shaped cross section.

The lower crossbar 23 is straight, may be made by an extrusion process and cut according to a predetermined length, is connected between the lower horizontal extension end portions 212 of the backrest sidebars 21.

Figure 5:
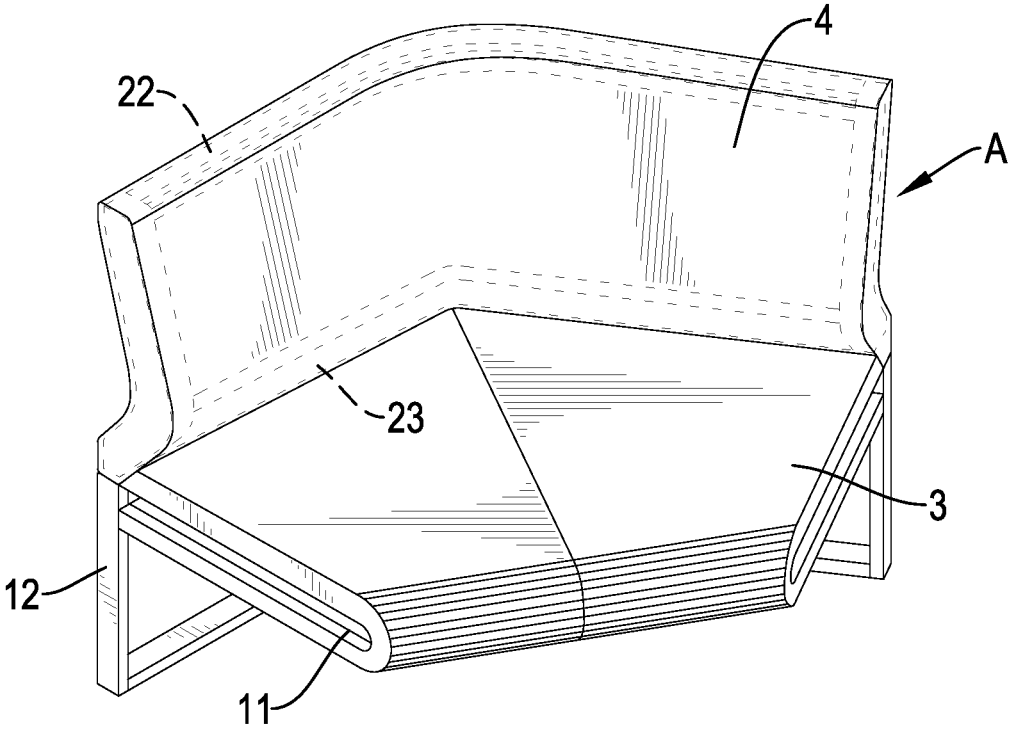
FIG. 5 is a perspective view of a second embodiment of a chair in accordance with the present invention.

The backrest pad 4 is mounted on a front surface of the backrest frame 2 and With reference to FIG. 5, a second embodiment of the chair A in accordance the present invention has a V-shaped upper crossbar 22 and a V-shaped lower crossbar 23. The horizontal frame 11 is pentagonal with a V-shaped rear. Thus, the chair A may be assembled in a furniture set and serve as a corner chair to make full use of indoor corner space. The angles of the V-shapes of the rear of the horizontal frame 11, the upper crossbar 22 and the lower crossbar 23 may be designed based on a furniture set in which the chair A is assembled in.

Figure 6:
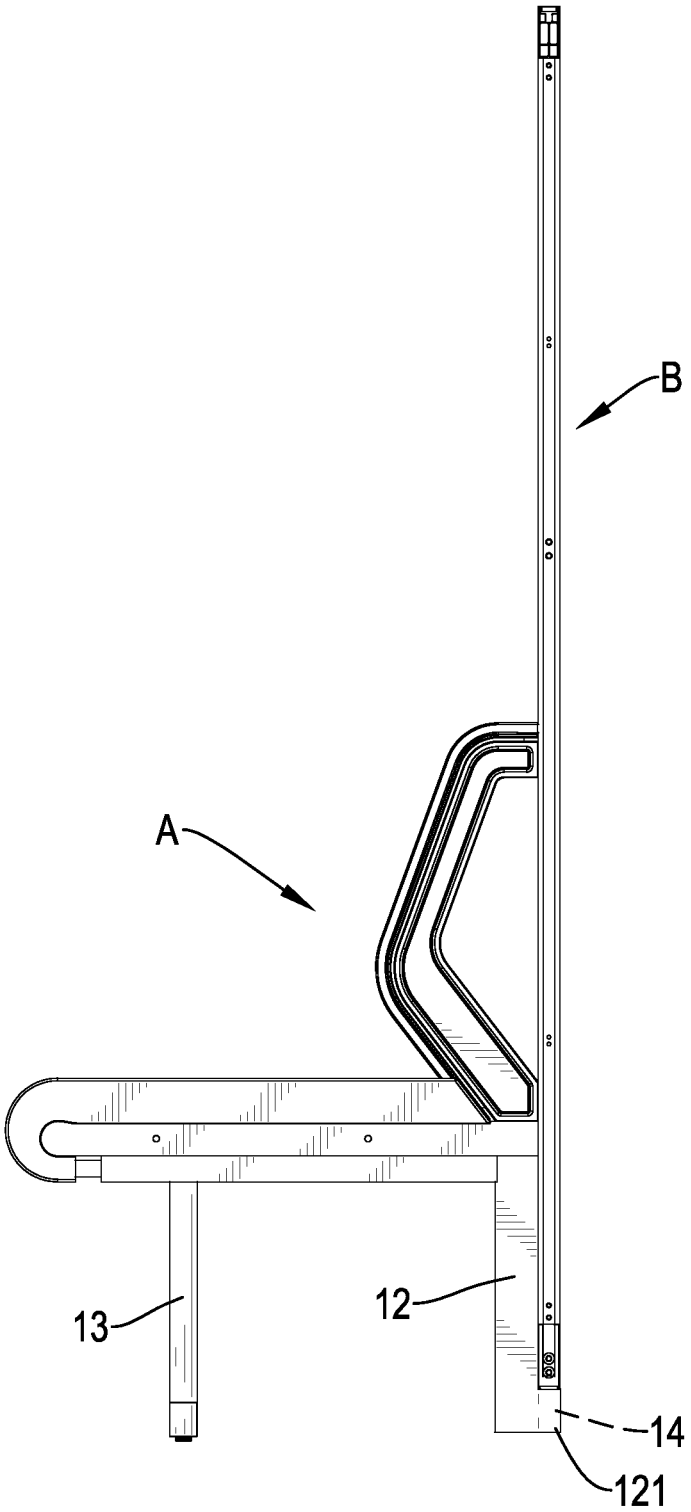
FIG. 6 is a side view of the chair in FIG. 1 combined with a screen to form a furniture set.

With further reference to FIG. 6, the chair A is assembled to a screen B that is used in offices, restrooms or conference rooms to form a basic furniture set. The screen B is mounted on a rear of the chair A. A bottom of the screen B is mounted on the horizontal top surfaces of the protrusions 121 of the rear supporting leg 12 and the top surface of the reinforcing crossbar 14. A front surface of the screen B bonds to a rear surface of the backrest frame 2 and rear surfaces of the rear supporting legs 12.

Figure 7:
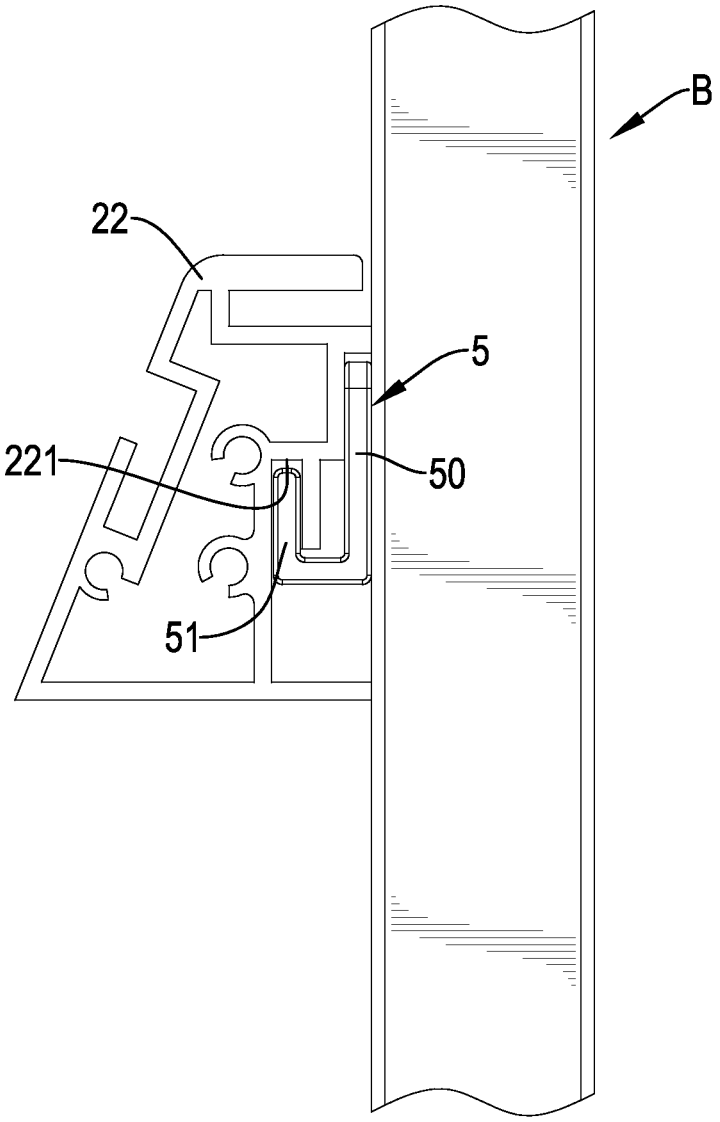
FIG. 7 is an enlarged side view of the upper crossbar of the chair and the screen in FIG. 6.
Figure 8:
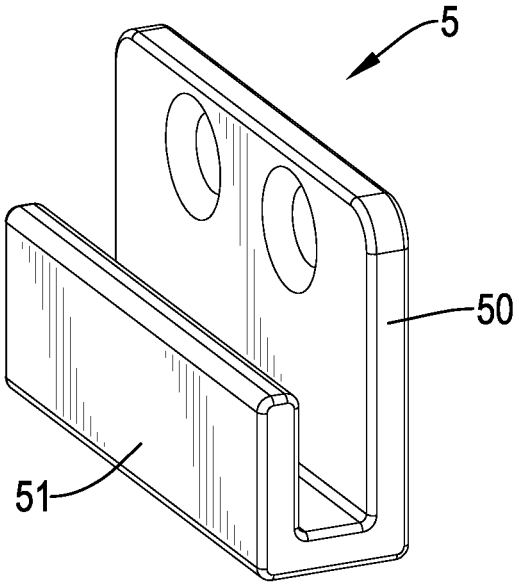
FIG. 8 is a perspective view of a suspension member of the screen in FIG. 6.

With further reference to FIGS. 7 and 8, a suspension member 5 is connected to the chair A and the screen B. The suspension member 5 has a backboard 50 and a hook 51.

The backboard 50 is mounted on the screen 50 by fasteners such as bolts.

The hook 51 is formed on and protrudes from the backboard 50 and is engaged with the L-shaped suspension slot 221.

The screen 5 may be a tall screen or a short screen dependent on requirements. The tall screen may be used to partition a space into two independent rooms. The short screen is used to separate two chairs.

Figure 9:
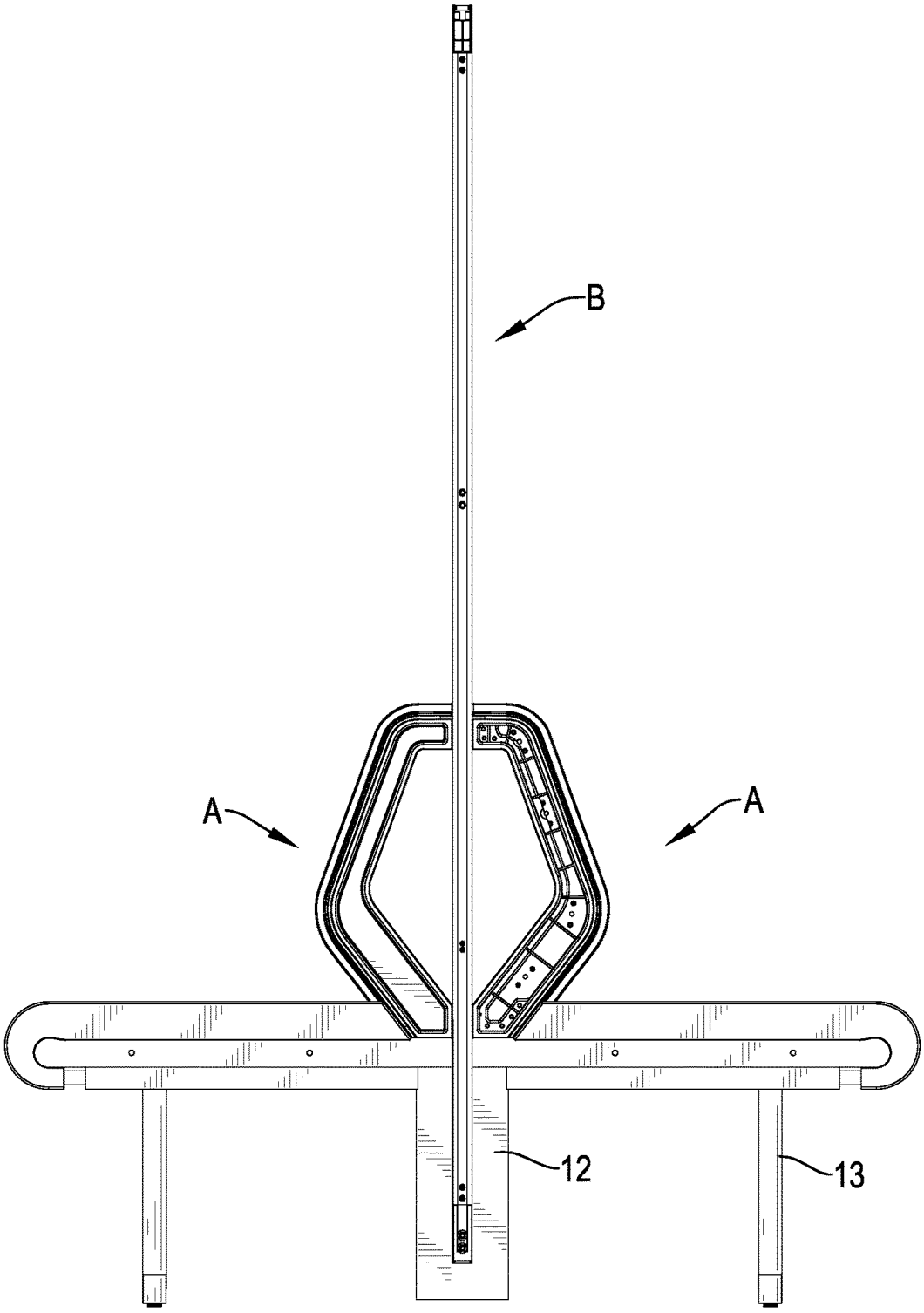
FIG. 9 is a side view of a pair of the chairs combined with the screen in FIG. 6 to form a furniture set.

With further reference to FIG. 9, two chairs A are mounted on opposite surfaces of the screen B. The screen B is mounted on the protrusions 121 of the rear supporting legs 12 of the chairs A. The protrusions 121 of the chairs A are connected together and may be formed integrally to enhance structural strength of the furniture set.

The aforementioned furniture set may be one screen B with one chair A mounted on one surface of the screen B, one screen B with two chairs A mounted on two opposite surfaces of the screen B, one screen B with multiple chairs A mounted on one surface of the screen B or one screen with two sets of multiple chairs A mounted on two opposite surfaces of the screen B. Alternatively, multiple screen B with multiple chairs A are assembled to form a large-scale furniture sets.

Figure 10:
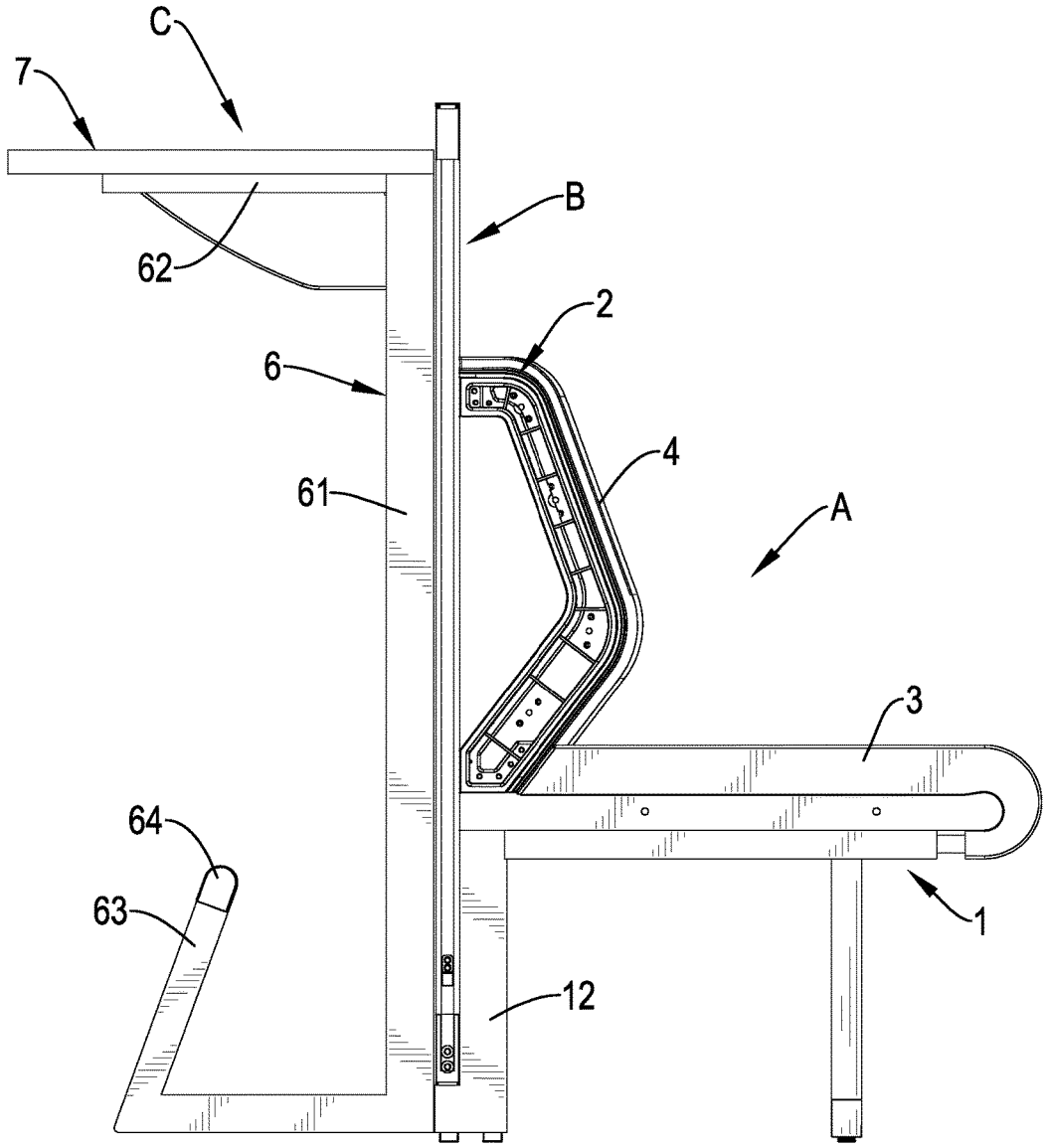
FIG. 10 is a side view of a table combined with the chair and the screen in FIG. 6 to form a furniture set.

With reference to FIG. 10, a table C is mounted on the screen B that is assembled to the chair A. The table C has two supporting members 6, a footrest crossbar 64 and a table board 7.

The supporting members 6 are mounted on the chair A and the screen B and are arranged oppositely. Each supporting member 6 has a table leg 61, a suspension arm 62 and an extension bar 63.

The table leg 61 is mounted on the chair A and the screen B.

The suspension arm 62 is mounted horizontally on top end of the table leg 61.

The extension bar 63 is formed on and protrudes from bottom end of the table leg 61 and extends obliquely upward.

The footrest crossbar 64 is mounted between the extension bars 63 of the supporting members 6 and allows a user to put feet on the footrest for improving comfortableness. The footrest crossbar 64 is applicable for highchairs.

The table board 7 is mounted on the suspension arms 62 of the supporting members 6 and may be opposite to the chair A or be at the same side with the chair A relative to the screen B.

Figure 16:
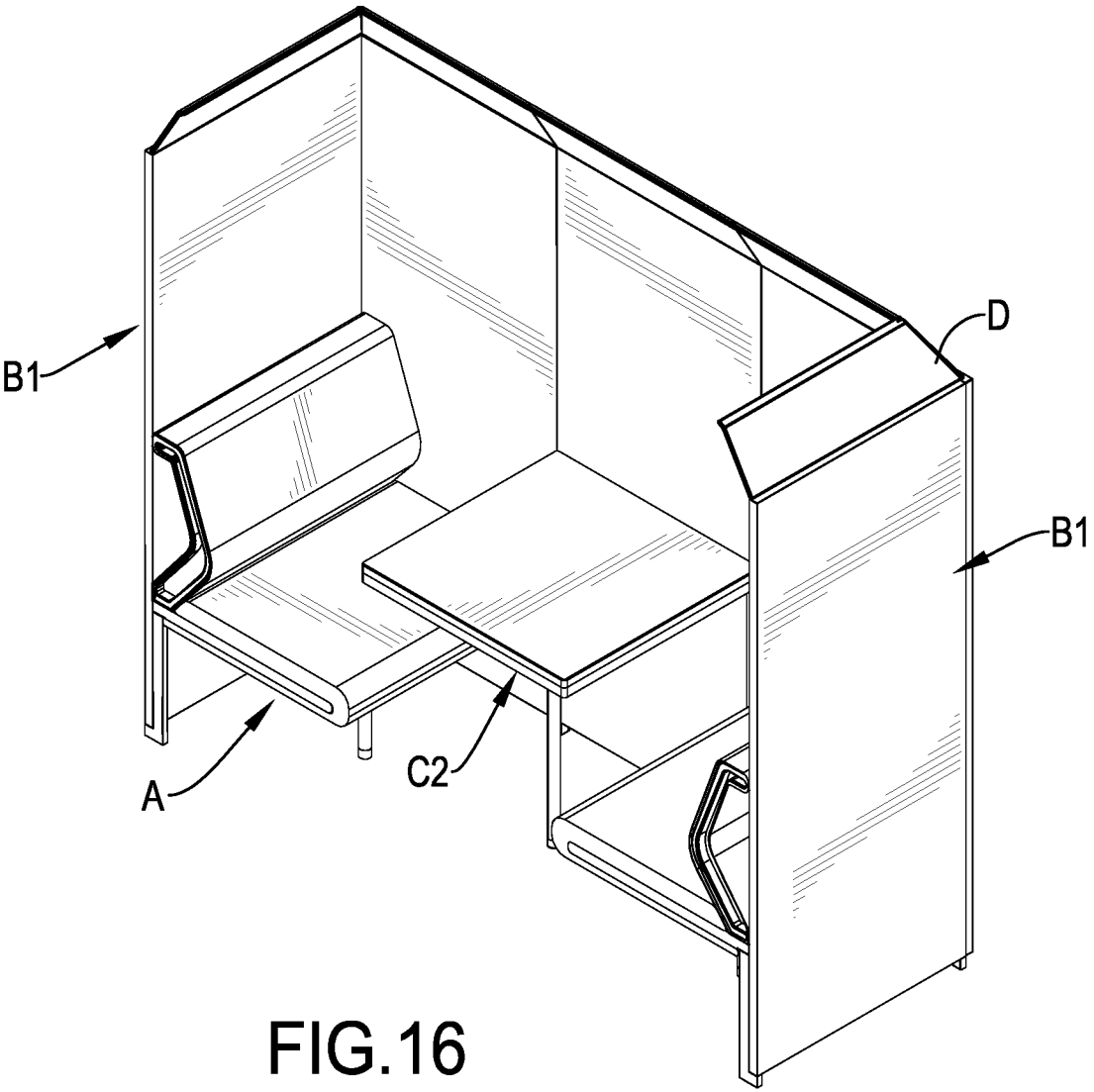
FIG. 16 is a perspective view of a fifth embodiment of the furniture set in accordance with the present invention.
Figure 21:
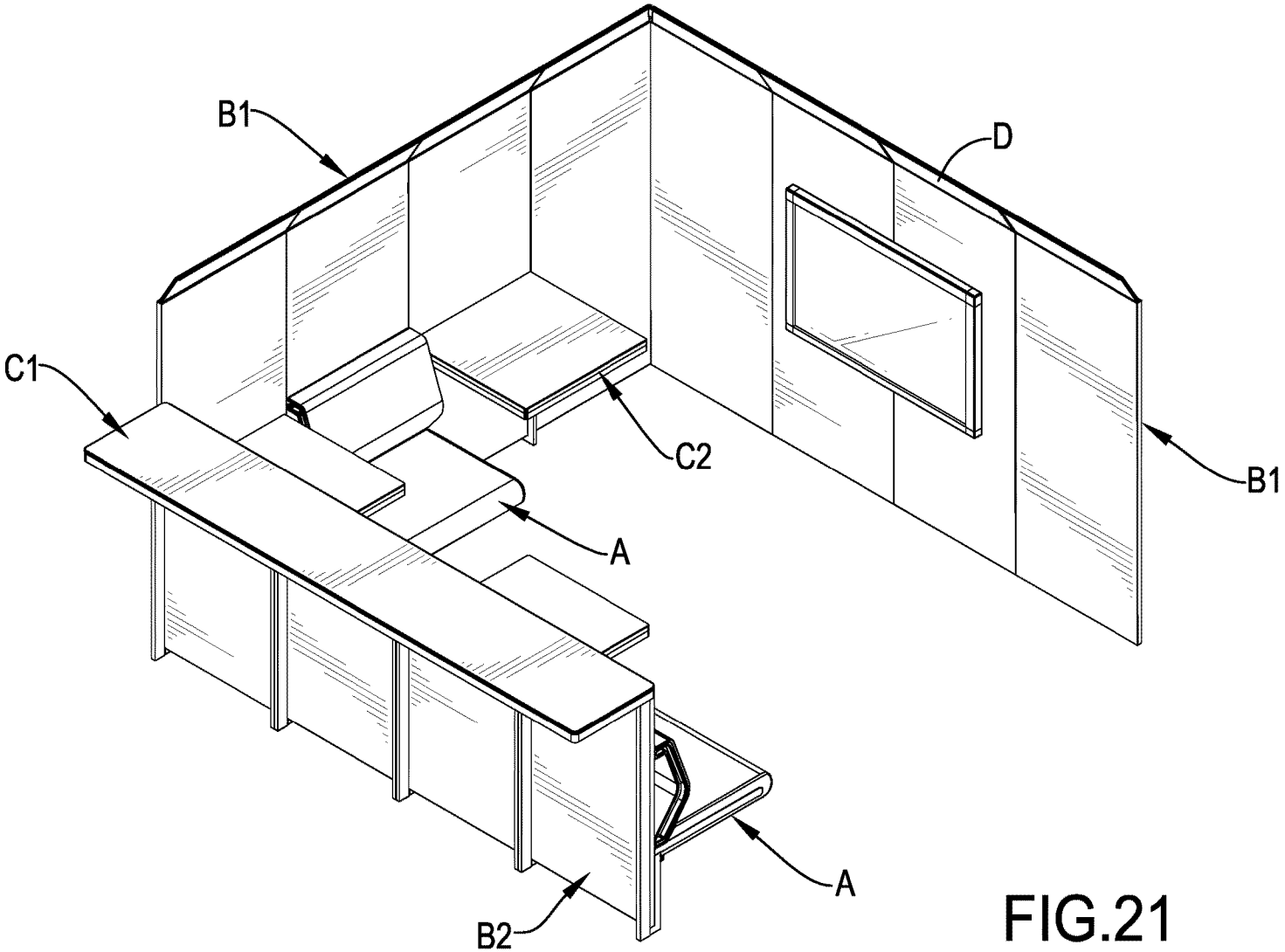
FIG. 21 is a perspective view of a ninth embodiment of the furniture set in accordance with the present invention.
Figure 22:
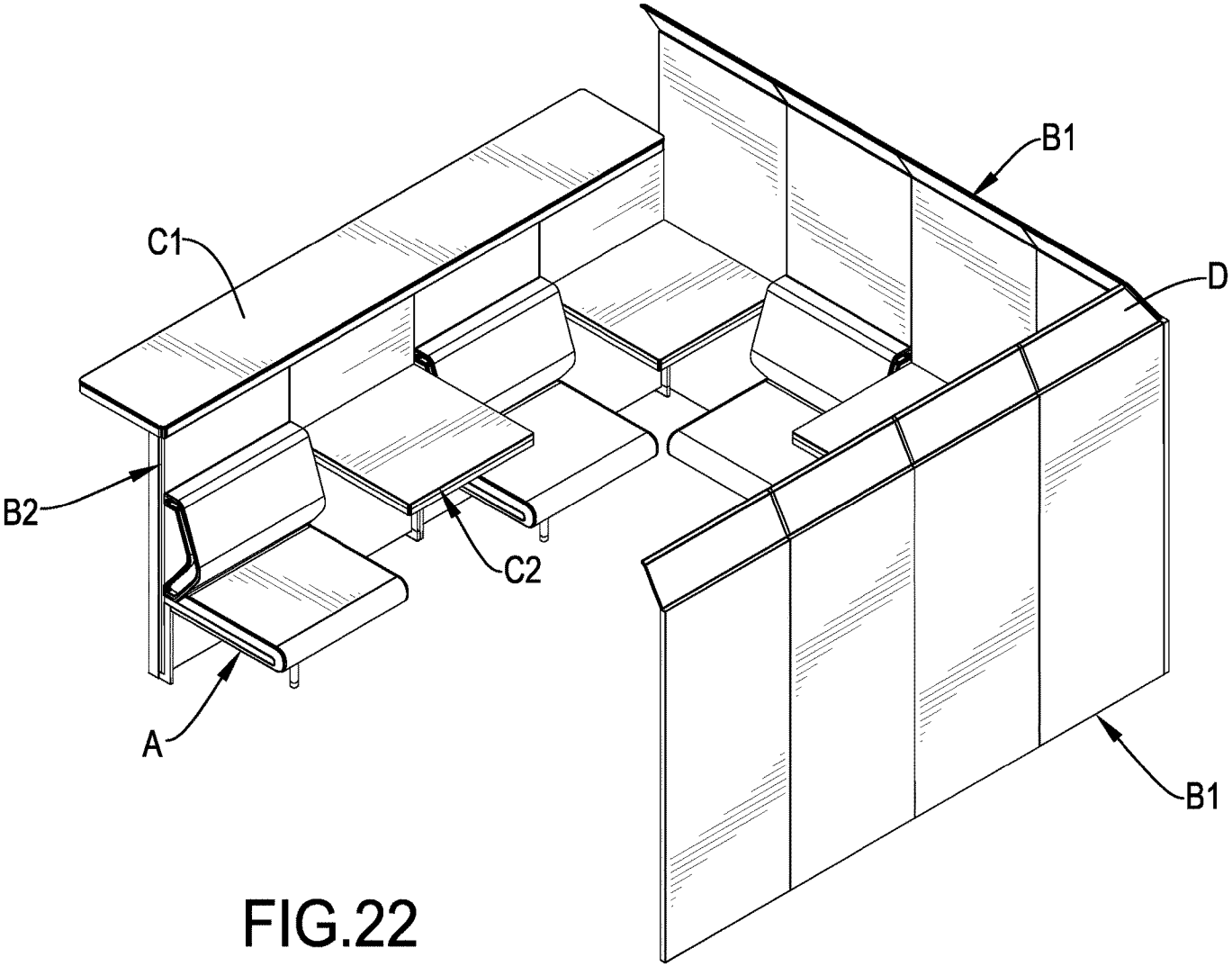
FIG. 22 is another perspective view of the ninth embodiment of the furniture set in accordance with the present invention.

The table may be a tall table C1 as shown in FIGS. 21 and 22. Alternatively, the table may be a short table C2, as shown in FIGS. 16, 21 and 22.

With reference to FIGS. 21 and 22, when the table is a tall table C1 and is mounted on the screen opposite to the chair A. Bottom ends of the table legs 61 of the supporting member 6 are mounted securely on or formed integrally on the protrusions 121 of the rear supporting legs 21 of the chair A. The screen B is mounted in a gap between the table legs 61 and the rear supporting legs 21. Two opposite surfaces of the screen B are bonded respectively to the chair A and the tall table C1.

With reference to FIG. 10, the chair A, screen B and table C are combined to form a general furniture set. The screen B serves as a partition to divide out independent rooms. The combination of the chair A and the table C fulfills basic requirements of office application. The chair A and the table C may be mounted on a same side or opposite sides of the screen B. Screens B may be arranged into form an enclosure. The chairs A and the tables C on the same may be disposed continuously such that adjacent chairs A is connected to a single table C.

Figure 11:
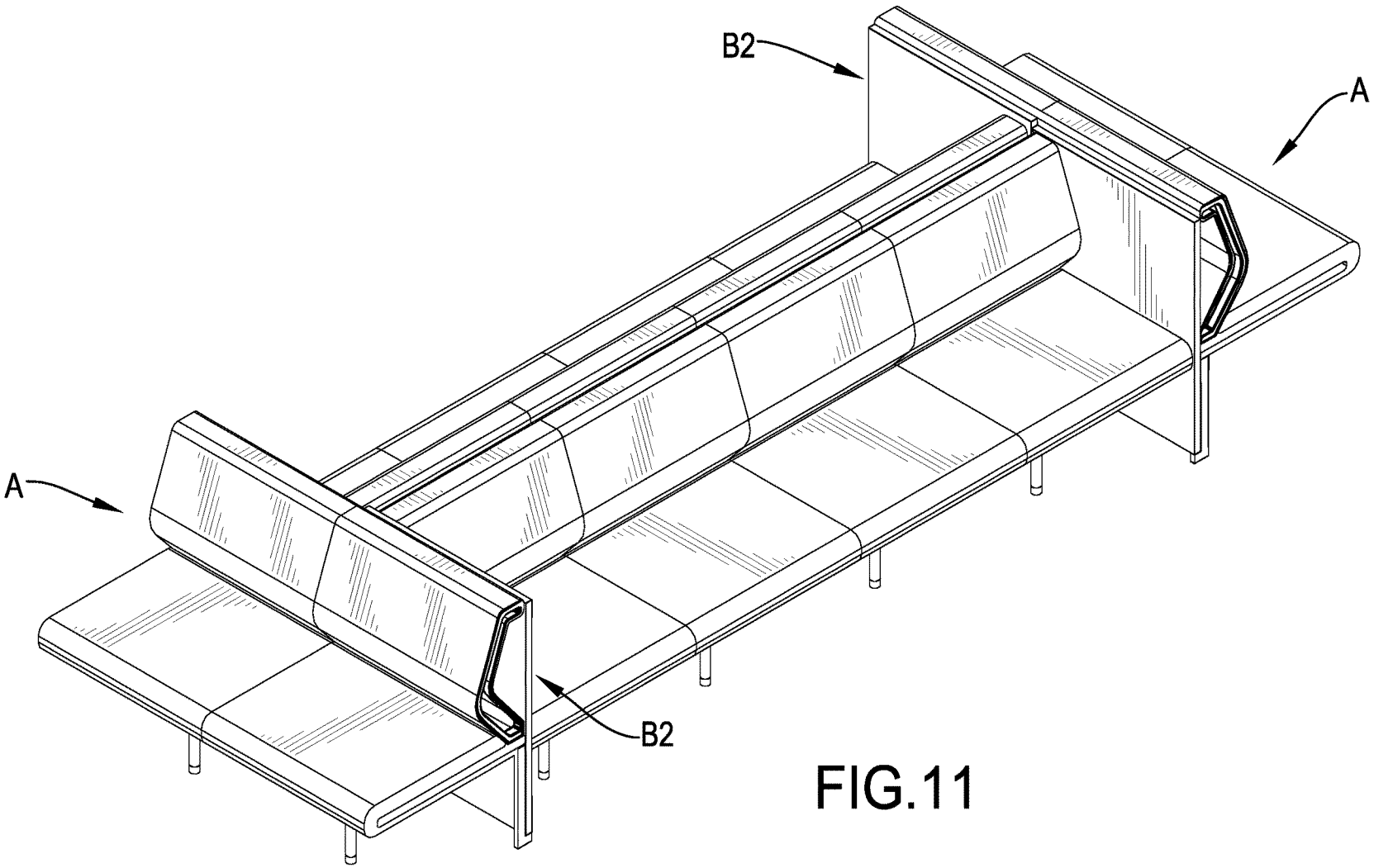
FIG. 11 is a perspective view of a first embodiment of the furniture set in accordance with the present invention.

With further reference to FIG. 11, a first embodiment of the furniture set has chairs A, and an H-shape screen B2. Pairs of the chairs A are arranged oppositely on two opposite sides of an intervening part of the H-shape screen B2. Two sets of multiple chairs A are mounted respectively on two end parts of the H-shape screen B2 to fully use space.

Figure 12:
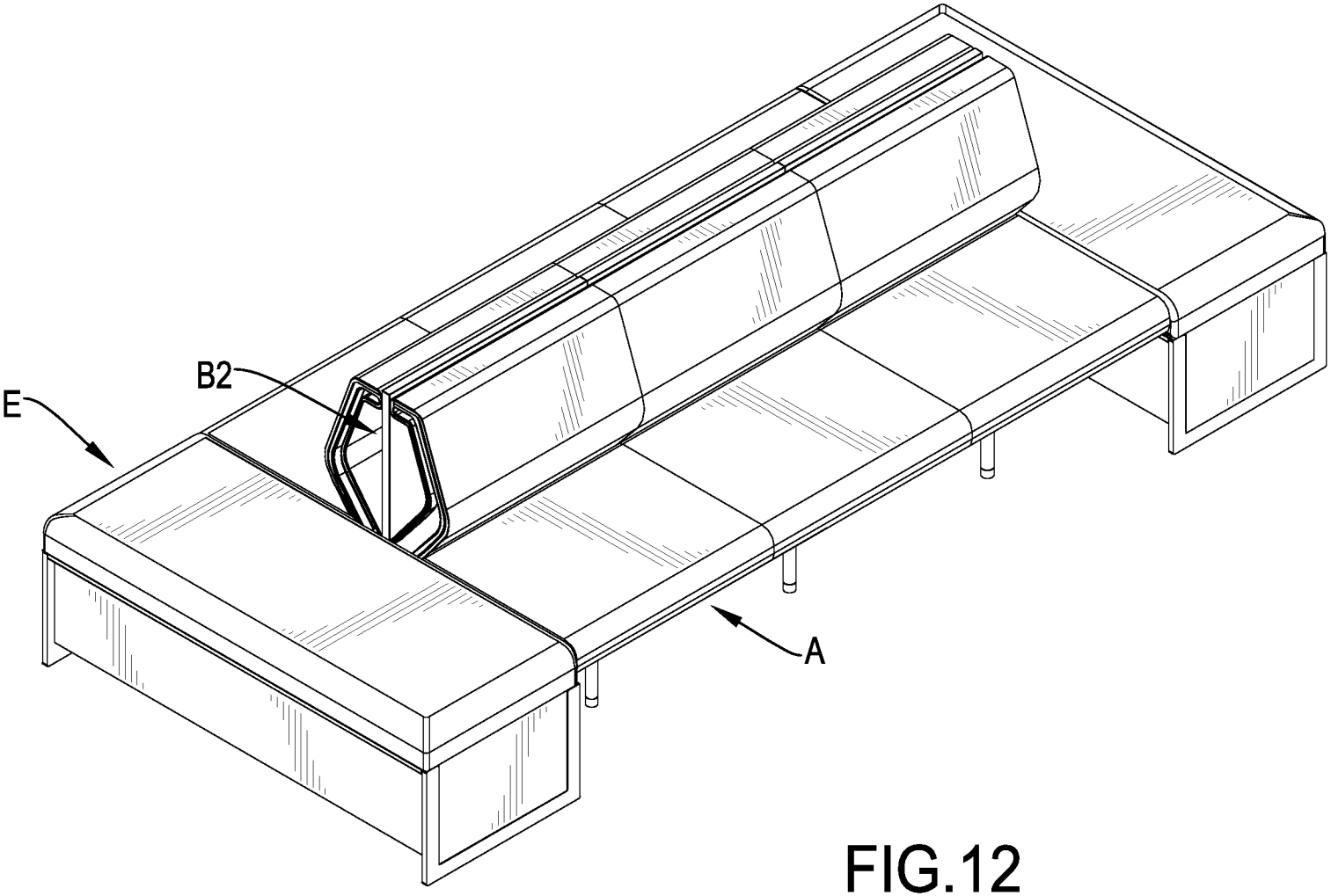
FIG. 12 is a perspective view of a second embodiment of the furniture set in accordance with the present invention.

With further reference to FIG. 12, a second embodiment of the furniture set replaces the end parts of the H-shape screen B2 and the chairs A on the end parts of the first embodiment with two sofas E. The sofas E are connected smoothly to adjacent chairs A for convenient use.

Figure 13:
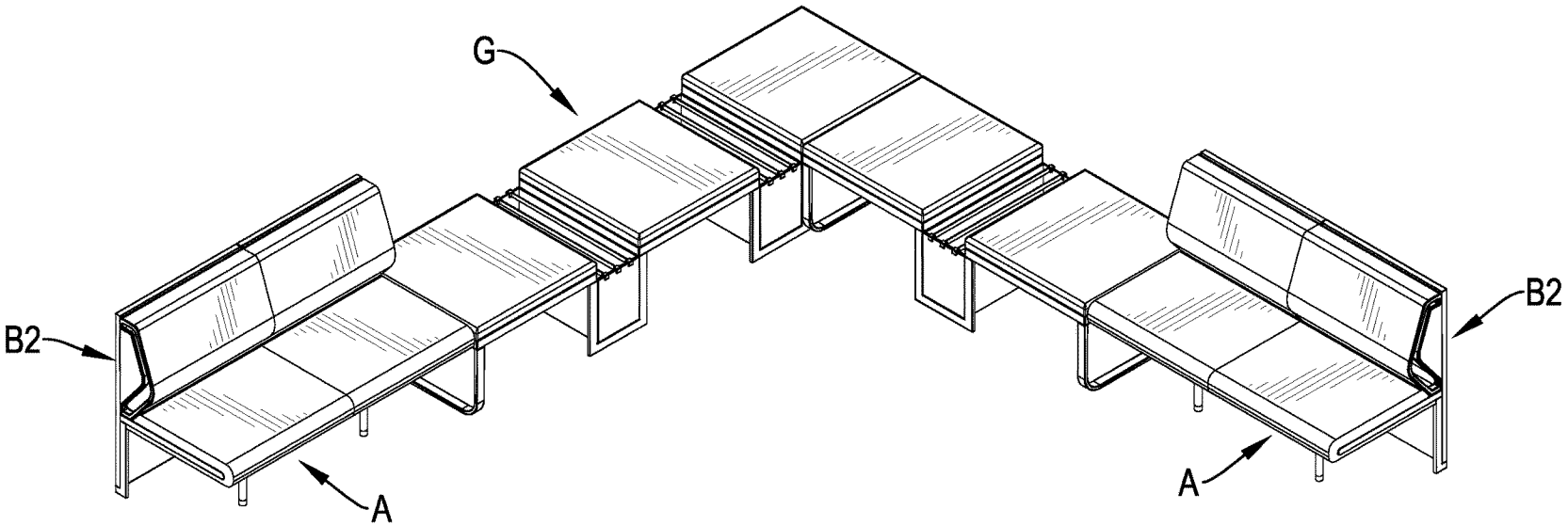
FIG. 13 is a perspective view of a third embodiment of the furniture set in accordance with the present invention.

With reference to FIG. 13, a third embodiment of the furniture set is arranged right-angular and has chairs A and a short screen B2 disposed at each of two ends. Benches G are disposed in a right-angular corner of the furniture set to o improve the convenience of use.

Figure 14:
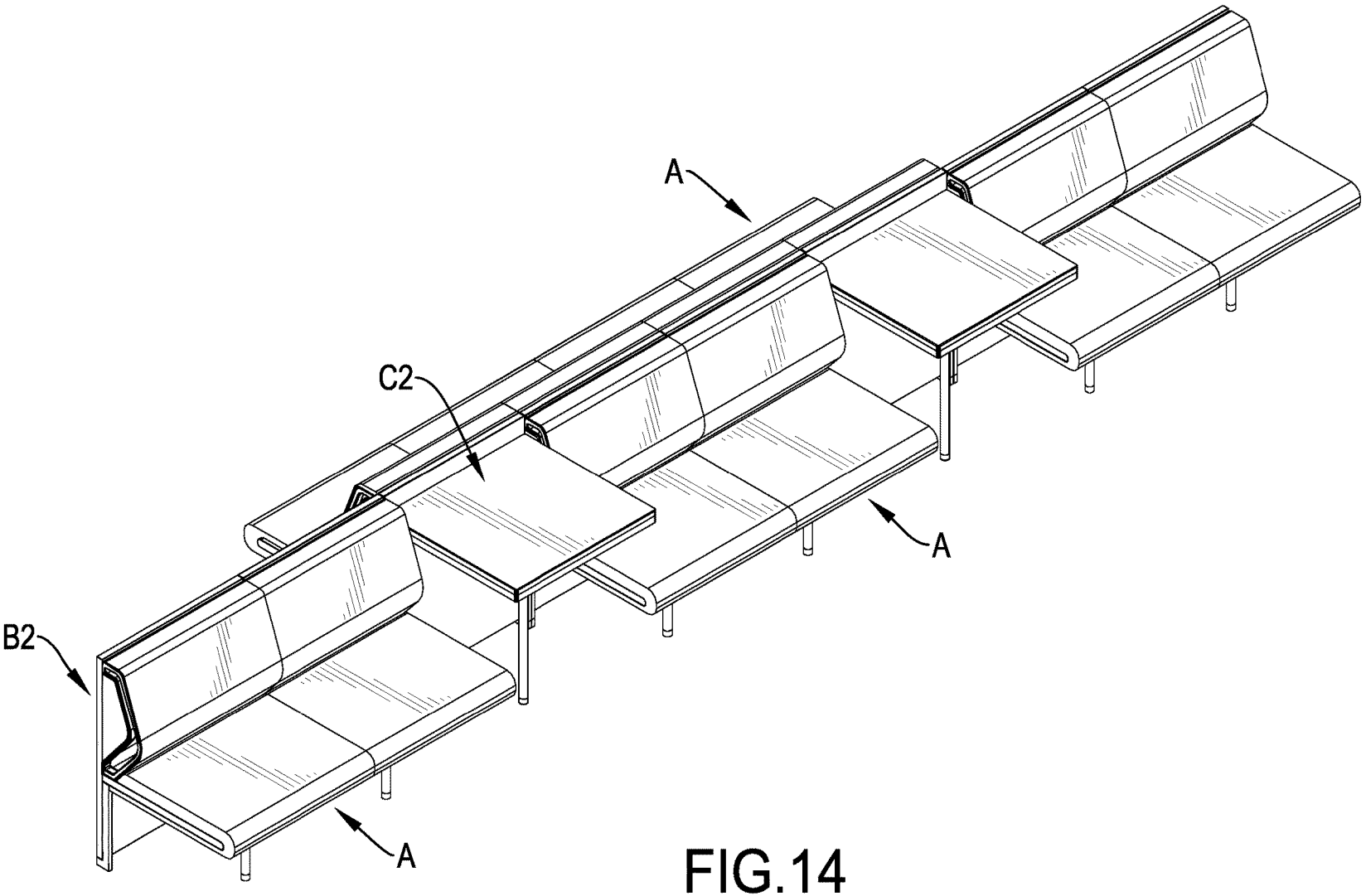
FIG. 14 is a perspective view of a fourth embodiment of the furniture set in accordance with the present invention.
Figure 15:
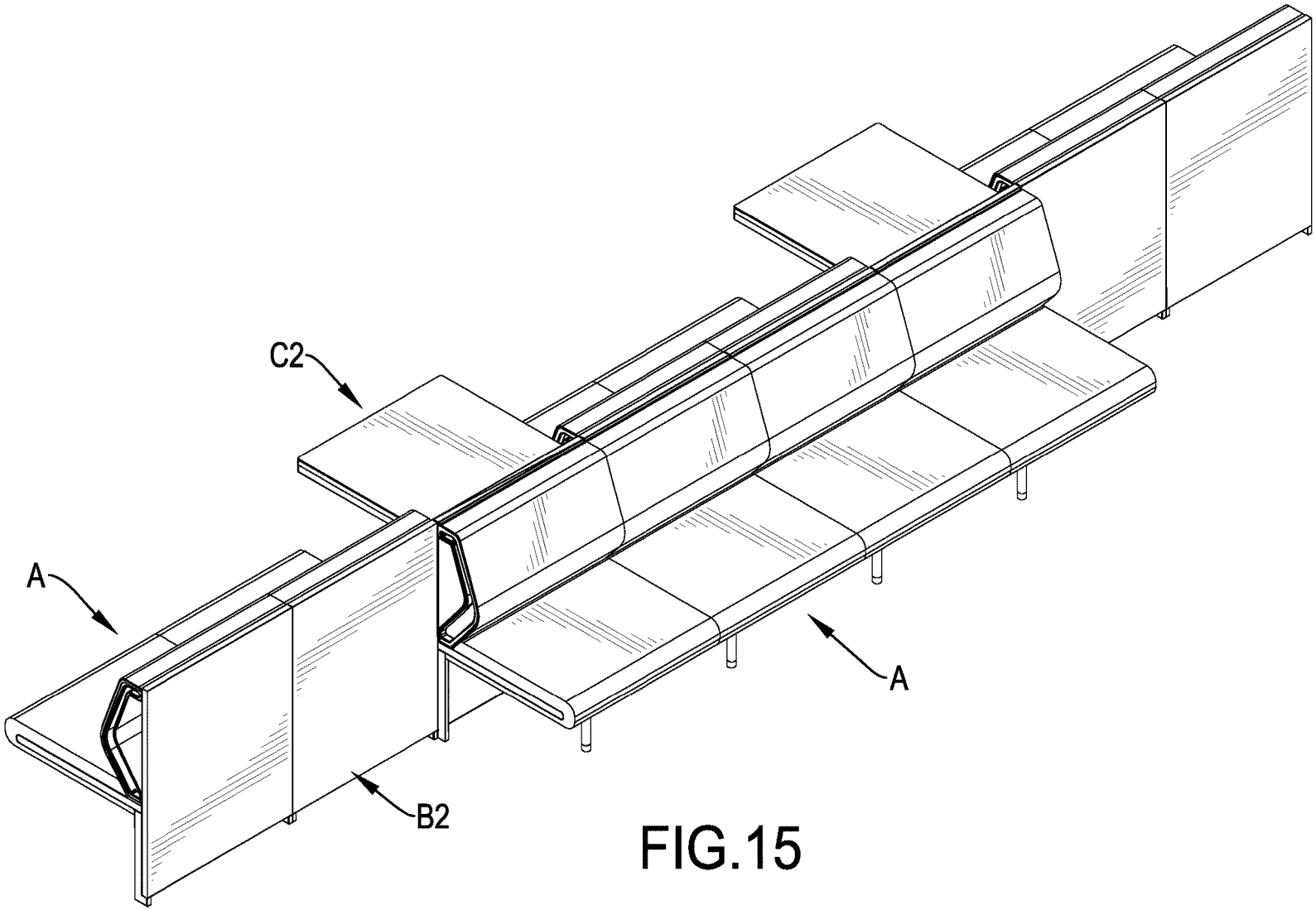
FIG. 15 is another perspective view of the fourth embodiment of the furniture set in accordance with the present invention.

With reference to FIGS. 14 and 15, a fourth embodiment of the furniture set has chairs A, short screens B2 and short tables C2. The short screens B2 are arranged in a straight line. The chairs A are mounted in two opposite sides of furniture set and the short tables C2 are mounted in the same side of the furniture set. Each short table C2 has a supporting leg.

With reference to FIG. 16, a fifth embodiment of the furniture set has chairs A, tall screens B1 and a short table C2. The tall screens B1 are arranged U-shaped to form three walls and an independent space defined therein for two people. The chairs A are mounted oppositely in the independent space and the short table C2 is mounted between the chairs A. Furthermore, each tall screen B1 has a noise board D to prevent ambient noise or internal noise passing in or out the independent space.

Figure 17:
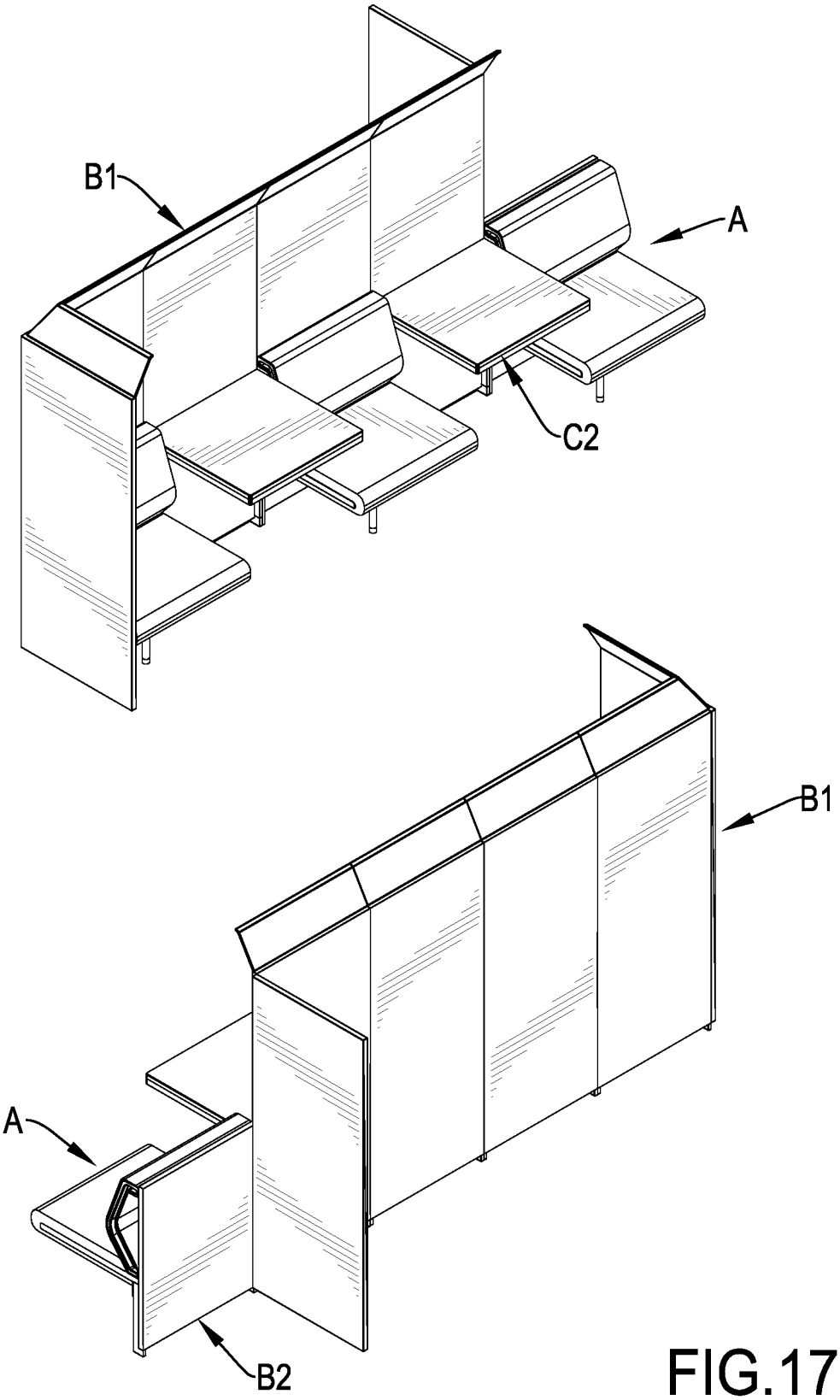
FIG. 17 is a perspective view of a sixth embodiment of the furniture set in accordance with the present invention

With reference to FIG. 17, a sixth embodiment of the furniture set has two sub furniture sets arranged opposite and staggered. Each sub furniture set is arranged in a line and has chairs A, tall screens B1, a short screen B2 and short tables C2. The tall screens B1 are connected to one another continuously. The outermost two of the tall screens B1 are folded in opposite directions. The short screen B2 is mounted adjacent to outermost one of the tall screens B1. The short tables C2 are mounted on one side of the tall screens B1 and are mounted on the supporting members that are disposed on the tall screens B1. The furniture set has characteristics of independence and openness and its applicability is improved.

Figure 18:
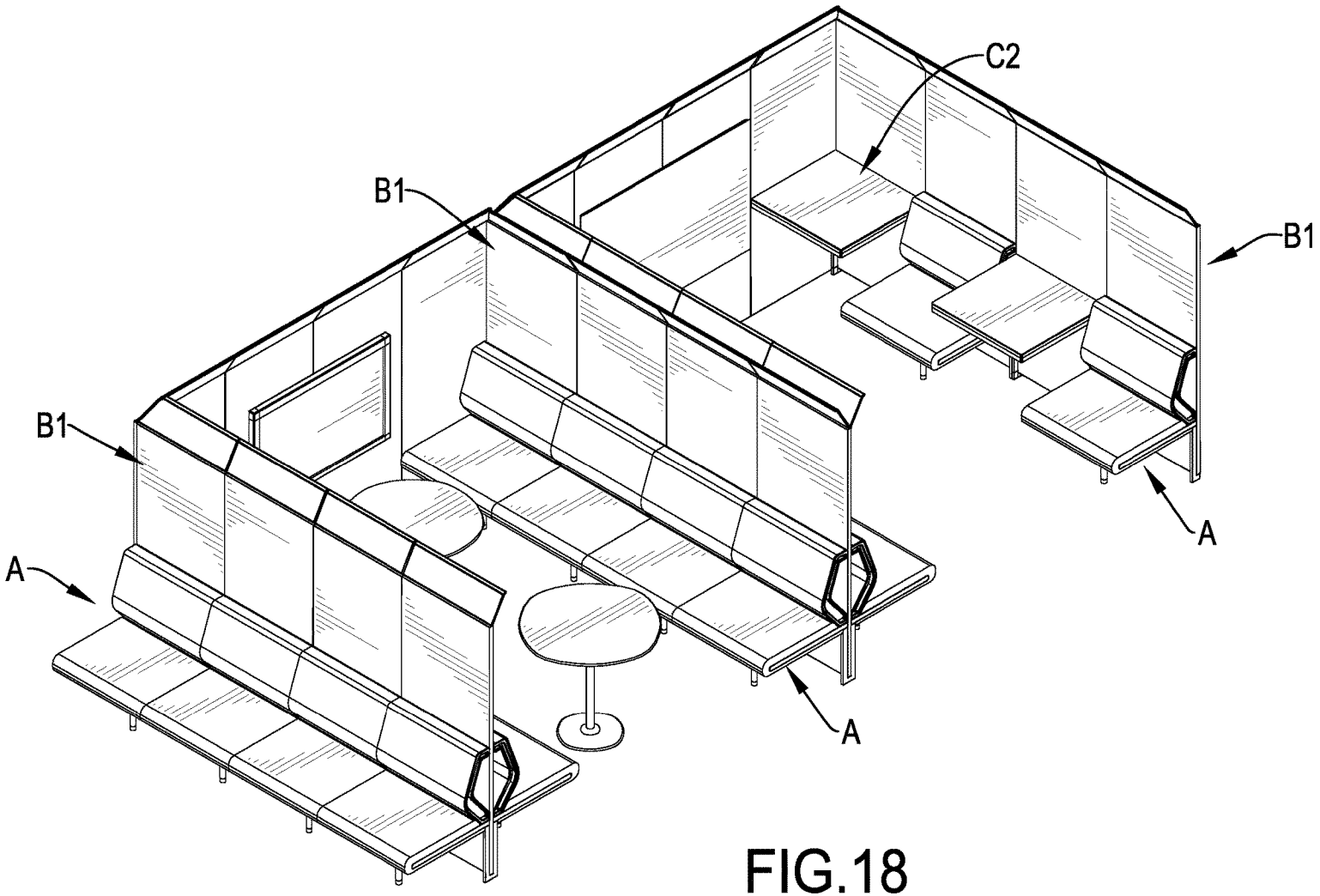
FIG. 18 is a perspective view of a seventh embodiment of the furniture set in accordance with the present invention.
Figure 19:
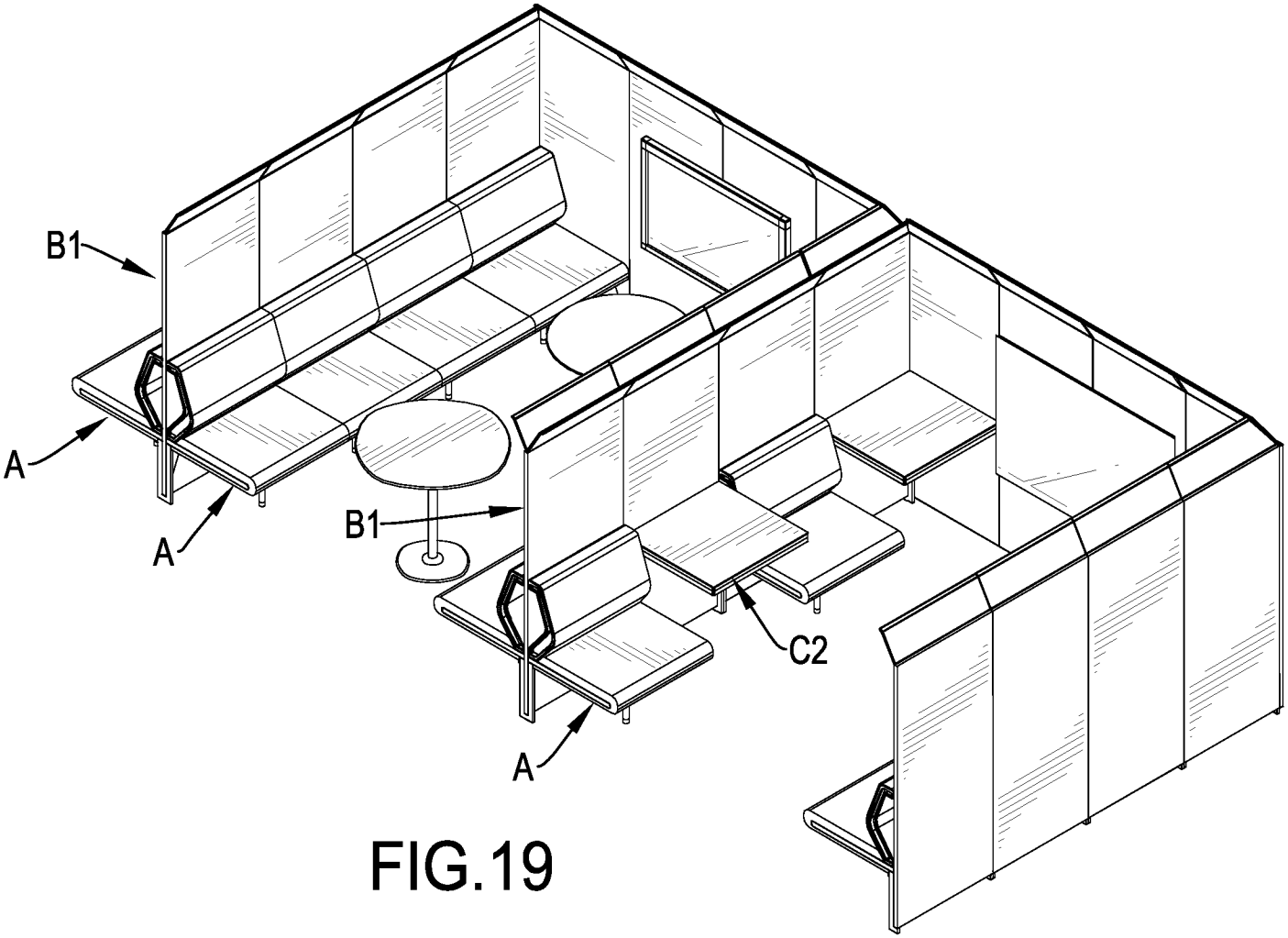
FIG. 19 is another perspective view of the seventh embodiment of the furniture set in accordance with the present invention.

With reference to FIGS. 18 and 19, a seventh embodiment of the furniture set has tall screens B1 arranged into an E-shaped configuration to divide out two independent spaces. Each independent space has three walls and an entrance. Two sets of chairs A and short tables C2 are mounted respectively on two opposite sides of each independent space. Two sets of chairs A are mounted on two opposite outsides of the furniture set. The furniture set may serve as restrooms, conference rooms.

Figure 20:
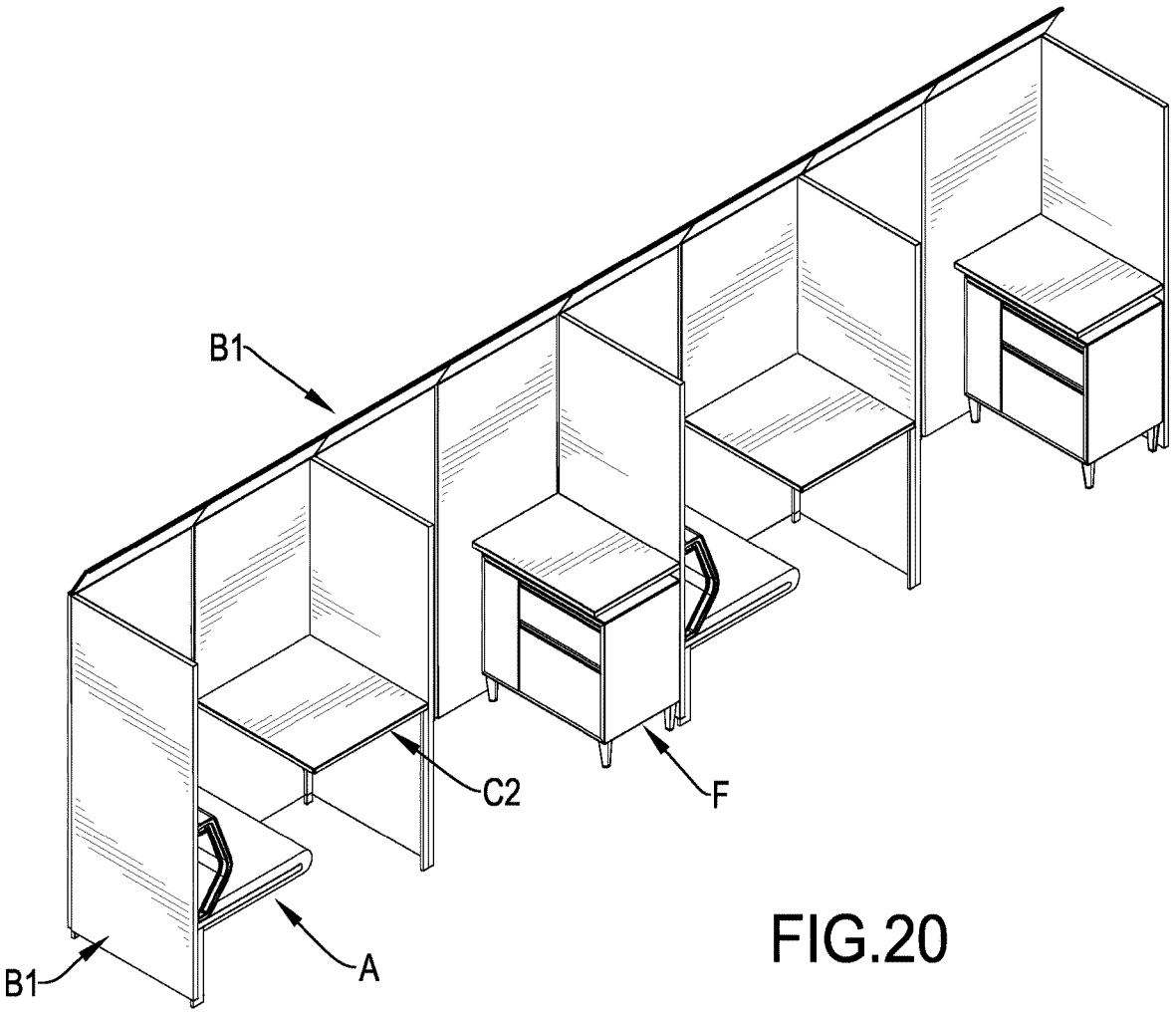
FIG. 20 is a perspective view of an eighth embodiment of the furniture set in accordance with the present invention.

With reference to FIG. 20, an eighth embodiment of the furniture set has a set of tall screens B1 arranged in a straight line and another set of tall screens B1 laterally mounted at intervals to divide out independent spaces. Each independent space has a chair A and a short table C2. Some of the independent spaces have cabinets F. The furniture set may be used in offices.

With reference to FIGS. 21 and 22, a ninth embodiment of the furniture set has tall screens Bland and short screens B2 arranged into an U-shaped configuration to form an independent space. The independent space has three walls and an entrance. The tall screens B1 are connected to form continuous two of the walls, and the short screens B2 form the other wall. A tall table C1 is mounted on an outside of the short screen B2. A chair A and short tables C1 is mounted on one wall formed by the high screens B1. The furniture set may serve as a restroom or a conference room.

Figure 23:
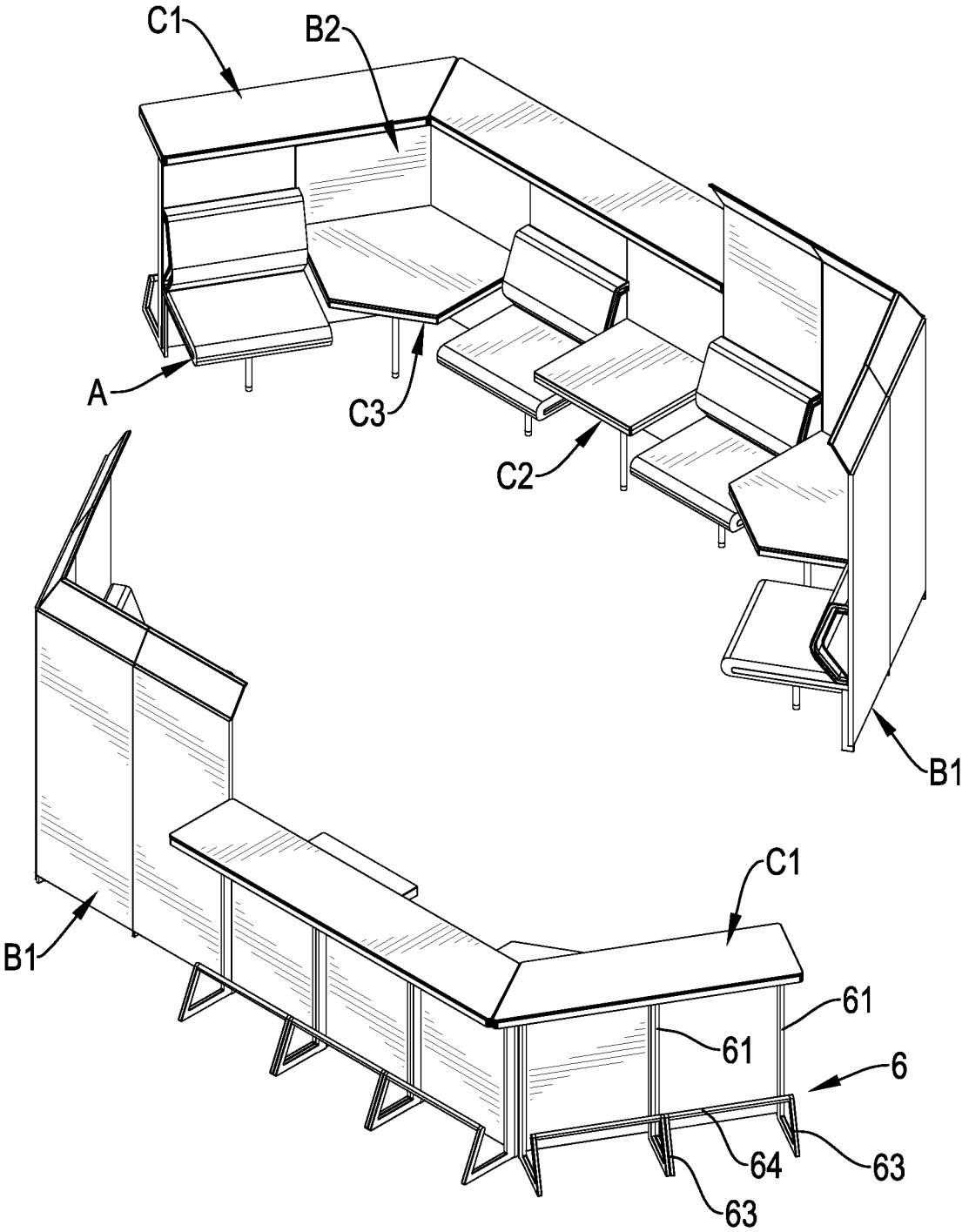
FIG. 23 is a perspective view of a tenth embodiment of the furniture set in accordance with the present invention.
Figure 24:
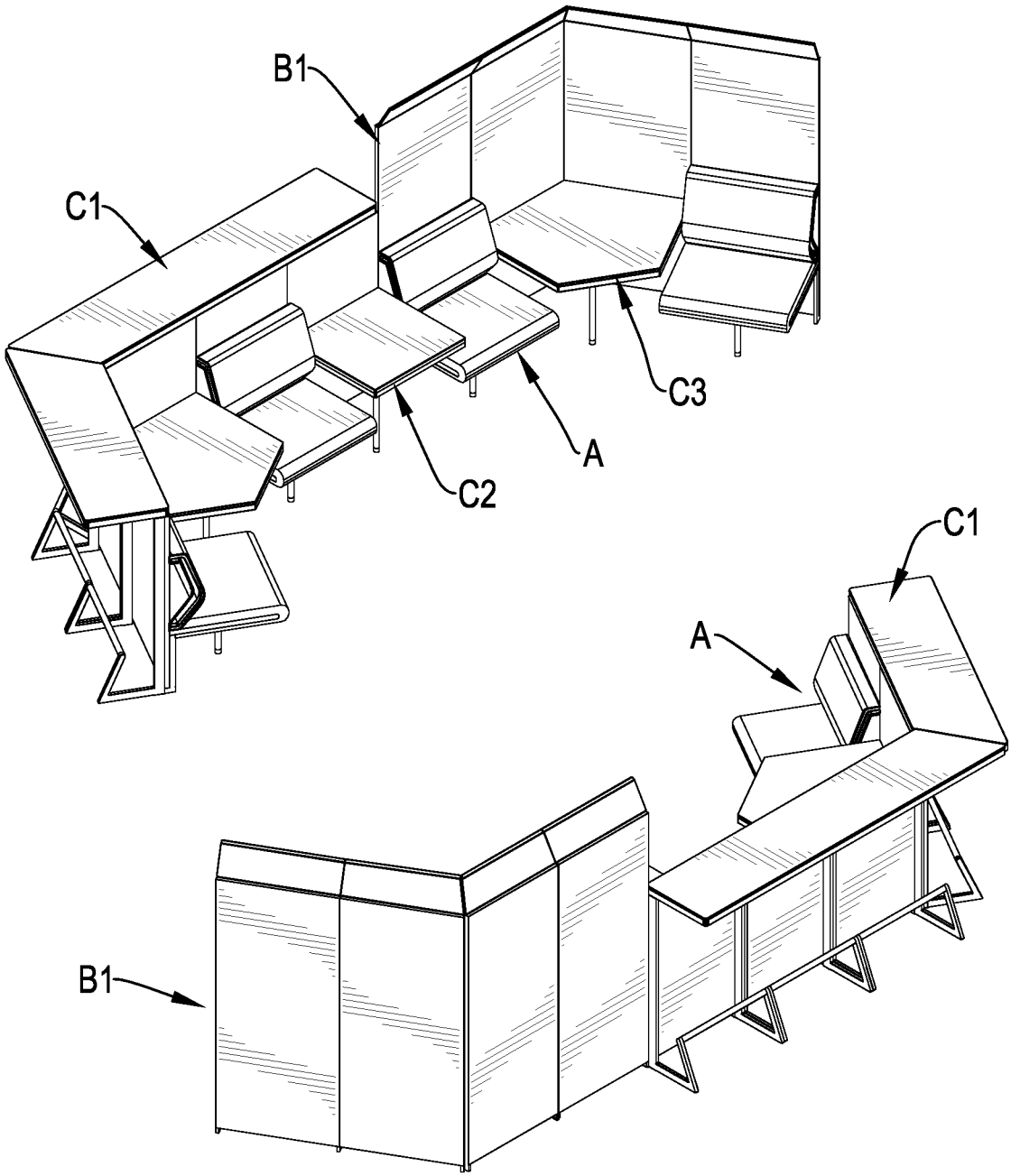
FIG. 24 is another perspective view of the tenth embodiment of the furniture set in accordance with the present invention.

With reference to FIGS. 23 and 24, a tenth embodiment of the furniture set has two sub furniture sets arranged opposite and staggered. Each sub furniture set has tall screens B1 and short screens B2 arranged in a polygonal line. Tall tables C1 are mounted on outsides of the short screens B2. Chairs A and a shot table C2 are mounted in inside of the tall screens B1 and the short screens B2. Polygonal short tables C3 are mounted in inside corners of the tall screens B1 and the short screens B2. The furniture set may be set in a passage.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A chair comprising:
- a seat member having
  - a seat body having
    - a horizontal frame disposed horizontally;
    - a front supporting leg mounted on a bottom surface of the horizontal frame near a front end of the horizontal frame; and
    - two rear supporting legs mounted respectively on two sides of a bottom surface of the horizontal frame near a rear end of the horizontal frame; and
  - a seat pad mounted on the seat body; and
- a backrest member having
  - a backrest frame having
    - two backrest sidebars mounted respectively on two sides of the horizontal frame; and
    - an upper crossbar connected between two top ends of the backrest sidebars and having a suspension slot defined in a rear surface of the upper crossbar, wherein the suspension slot is axially elongated and has an L-shaped cross section; and
  - a backrest pad mounted on a front surface of the backrest frame.

2. The chair as claimed in claim 1, wherein each rear supporting leg has a protrusion formed on and protruding outward from the rear supporting leg and having a horizontal top surface.

3. The chair as claimed in claim 1, wherein
- each backrest sidebar has
  - an upper horizontal extension end portion formed on a top end of the backrest sidebar; and
  - a lower horizontal extension end portion formed on a bottom end of the backrest sidebar;
- the upper crossbar is connected between the upper horizontal extension end portions of the backrest sidebars; and
- a lower crossbar is connected between the lower horizontal extension end portions of the backrest sidebars.

4. The chair as claimed in claim 2, wherein
- each backrest sidebar has
  - an upper horizontal extension end portion formed on a top end of the backrest sidebar; and
  - a lower horizontal extension end portion formed on a bottom end of the backrest sidebar;

the upper crossbar is connected between the upper horizontal extension end portions of the backrest sidebars; and a lower crossbar is connected between the lower horizontal extension end portions of the backrest sidebars.

5. The chair as claimed in claim 3, wherein the horizontal frame is rectangular; and the upper crossbar and the lower crossbar are straight.

6. The chair as claimed in claim 4, wherein the horizontal frame is rectangular; and the upper crossbar and the lower crossbar are straight.

7. The chair as claimed in claim 3, wherein the upper crossbar and the lower crossbar are V-shaped; and the horizontal frame is pentagonal with a V-shaped rear.

8. The chair as claimed in claim 4, wherein the upper crossbar and the lower crossbar are V-shaped; and the horizontal frame is pentagonal with a V-shaped rear.

9. A furniture set comprising a chair having a seat member having a seat body having a horizontal frame disposed horizontally;

a front supporting leg mounted on a bottom surface of the horizontal frame near a front end of the horizontal frame; and two rear supporting legs mounted respectively on two sides of a bottom surface of the horizontal frame near a rear end of the horizontal frame; and a seat pad mounted on the seat body; and a backrest member having a backrest frame having two backrest sidebars mounted respectively on two sides of the horizontal frame; and an upper crossbar connected between two top ends of the backrest sidebars and having a suspension slot defined in a rear surface of the upper crossbar, wherein the suspension slot is axially elongated and has an L-shaped cross section; and a backrest pad mounted on a front surface of the backrest frame; and at least one screen mounted on a rear of the chair;

a suspension member connected to the chair and the screen and having a backboard mounted on the screen by fasteners; and a hook formed on and protruding from the backboard and engaged with the suspension slot.

10. The furniture set as claimed in claim 9, wherein a table is mounted on the screen and has two supporting members mounted on the chair and the screen, arranged oppositely and having a table leg mounted on the chair and the screen; and a suspension arm mounted horizontally on top end of the table leg; and a table board mounted on the suspension arms of the supporting members.

11. The furniture set as claimed in claim 10, wherein the table board is at the same side with the chair relative to the screen.

12. The furniture set as claimed in claim 10, wherein the table board is opposite to the chair relative to the screen.

13. The furniture set as claimed in claim 10, wherein each supporting member further has an extension bar formed on and protruding from bottom end of the table leg and extending obliquely upward.

14. The furniture set as claimed in claim 13, wherein the table further has a footrest crossbar mounted between the extension bars of the supporting members.

* * * * *